US006148282A

United States Patent [19]

Paksoy et al.

[11] Patent Number: 6,148,282

[45] Date of Patent: Nov. 14, 2000

[54] MULTIMODAL CODE-EXCITED LINEAR PREDICTION (CELP) CODER AND METHOD USING PEAKINESS MEASURE

[75] Inventors: Erdal Paksoy, Richardson; Alan V. McCree, Dallas, both of Tex.

[73] Assignee: Texas Instruments Incorporated, Dallas, Tex.

[21] Appl. No.: 08/999,433

[22] Filed: Dec. 29, 1997

Related U.S. Application Data

[60] Provisional application No. 60/034,476, Jan. 2, 1997.

[51] Int. Cl.[7] ..... G10L 19/04; G10L 11/06

[52] U.S. Cl. ..... 704/219; 704/208; 704/214

[58] Field of Search ..... 704/208, 214, 704/219

[56] References Cited

U.S. PATENT DOCUMENTS

| | | | |
|---|---|---|---|
| 5,327,520 | 7/1994 | Chen . | |
| 5,495,555 | 2/1996 | Swaminathan | 704/207 |
| 5,596,676 | 1/1997 | Swaminathan et al. | 704/208 |
| 5,657,418 | 8/1997 | Gerson et al. | 704/207 |
| 5,734,789 | 3/1998 | Swaminathan et al. | 704/206 |
| 5,737,484 | 4/1998 | Ozawa | 704/219 |

FOREIGN PATENT DOCUMENTS

| | | |
|---|---|---|
| 0 503 684 A2 | 9/1992 | European Pat. Off. . |
| 0 718 822 A2 | 6/1996 | European Pat. Off. . |
| WO 95/15549 | 6/1995 | WIPO . |

OTHER PUBLICATIONS

Bishnu S. Atal and Lawrence R. Rabiner, "A Pattern Recognition Approach to Voiced–Unvoiced–Silence Classification with Applications to Speech Recognition," IEEE Trans. Acoustics, Speech, and Signal Processing, vol. ASSP–24, No. 3, p. 201–212, Jun. 1976.

Alan V. McCree, et al., "A Mixed Excitation LPC Vocoder Model for Low Bit Rate Speech Coding," *IEEE*, vol. 3, No. 4, pp. 242–249, Jul. 1995.

Erdal Paksoy, et al., "A Variable–Rate Multimodal Speech Coder with Gain–Matched Analysis–by–Synthesis," *IEEE*, vol. 2, pp. 751–754, Apr. 1997.

David L. Thomson and Dimitrios P. Prezas, "Selective Modeling of the LPC Residual During Unvoiced Frames: White Noise or Pulse Excitation," IEEE International Conference on Acoustics Speech and Signal Processing 1986 Tokyo.

Join–Hwey Chen, "Toll–Quality 16 KB/S CELP Speech Coding with Very Low Complexity," IEEE International Conference on Acoustics Speech and Signal Processing 1995 Detroit.

*Primary Examiner*—David R. Hudspeth
*Assistant Examiner*—Tālivaldis Ivars Šmits
*Attorney, Agent, or Firm*—Robert L. Troike; Frederick J. Telecky, Jr.

[57] ABSTRACT

A multimodal code-excited linear prediction (CELP) speech coder determines a pitch-lag-periodicity-independent peakiness measure from the input speech. If the measure is greater than a peakiness threshold the encoder classifies the speech in a first coding mode. In one embodiment only frames having an open-loop pitch prediction gain not greater than a threshold, a zero-crossing rate not less than a threshold, and a peakiness measure not greater than the peakiness threshold will be classified as unvoiced speech. Accordingly, the beginning or end of a voiced utterance will be properly coded as voiced speech and speech quality improved. In another embodiment, gain-match scaling matches coded speech energy to input speech energy. A target vector (the portion of input speech with any effects of previous signals removed) is approximated using the precomputed gain for excitation vectors while minimizing perceptually-weighted error. The correct gain value is perceptually more important than the shape of the excitation vector for most unvoiced signals.

22 Claims, 2 Drawing Sheets

MULTIMODAL CODE-EXCITED LINEAR PREDICTION (CELP) CODER AND METHOD USING PEAKINESS MEASURE

This application claims priority of provisional application Ser. No. 60/034,476, filed Jan. 2, 1997.

TECHNICAL FIELD OF THE INVENTION

The present invention relates generally to the field of speech coding, and more particularly to an improved multimodal code-excited linear prediction (CELP) coder and method.

BACKGROUND OF THE INVENTION

Code-excited linear prediction (CELP) is a well-known class of speech coding with good performance at low to medium bit-rates, 4 to 16, kb/s. CELP coders generally operate on fixed-length segments of an input signal called frames. A multimodal CELP coder is one that classifies each input frame into one of several classes, called modes. Modes are characterized by distinct coding techniques.

Typically, multimodal CELP coders include separate modes for voiced and unvoiced speech. CELP coders have employed various techniques to distinguish between voiced and unvoiced speech. These techniques, however, generally fail to properly characterize certain transient sounds as voiced speech. Another common problem in CELP coders is that the output speech gain does not always match the input gain.

SUMMARY OF THE INVENTION

Accordingly, a need has arisen in the art for an improved multimodal speech coder. The present invention provides a multimodal speech coder and method that substantially reduces or eliminates the disadvantages and problems associated with prior systems.

In accordance with the present invention, speech may be classified by receiving a speech input and getting a peakiness measure of the speech input. It may then be determined if the peakiness measure is greater than a peakiness threshold. If the peakiness measure is greater than the peakiness threshold, the speech input may be classified in a first mode of a multimodal speech coder including a code-excited linear prediction mode.

More specifically, in accordance with one embodiment of the present invention, the speech classification method may further include getting an open-loop pitch prediction gain and a zero-crossing rate of the speech input. It may then be determined if the open-loop pitch prediction gain is greater than an open-loop pitch prediction gain threshold and if the zero-crossing rate is less than a zero-crossing rate threshold. In either case, the speech input may be classified in the first mode of the multimodal speech coder including the code-excited linear prediction mode. Where the speech input is not classified in the first mode, the speech input may be classified in a second mode having excitation vectors with a greater number of non-zero elements.

In accordance with another aspect of the present invention, speech may be encoded using gain-matched analysis-by-synthesis. In accordance with this aspect of the invention, a gain value may be gotten from a speech input. A target vector may then be obtained from the speech input and gain normalized. An optimum excitation vector may be determined by minimizing an error between the gain normalized target vector and a synthesized-filtered excitation vector.

Important technical advantages of the present invention include providing an improved multimodal code-excited linear prediction (CELP) coder and system. In particular, the multimodal CELP coder may include a peakiness module operable to properly classify and encode voiced speech having a short burst of high-energy pulses followed by a relatively quiet, noise-like interval as voice speech. Accordingly, unvoiced plosives such as /t/, /k/, and /p/ may be properly classified in a mode having any excitation vector with a fewer number of non-zero elements.

Another technical advantage of the present invention includes providing gain-matched analysis-by-synthesis encoding for unvoiced speech. In particular, the CELP coder may match coded speech gain to speech input gain. The speech input may then be normalized with the gain. Analysis-by-synthesis may then be performed by the CELP coder to determine excitation parameters of the speech input. The gain match substantially reduces or eliminates unwanted gain fluctuations generally associated with coding unvoiced speech at low bit-rates.

Other technical advantages will be readily apparent to one skilled in the art from the following figures, descriptions, and claims.

BRIEF DESCRIPTION OF THE DRAWINGS

For a more complete understanding of the present invention and its advantages thereof, reference is now made to the following description taken in conjunction with the accompanying drawings, wherein like reference numerals represent like parts, in which.

DETAILED DESCRIPTION OF THE INVENTION

Figure 1:
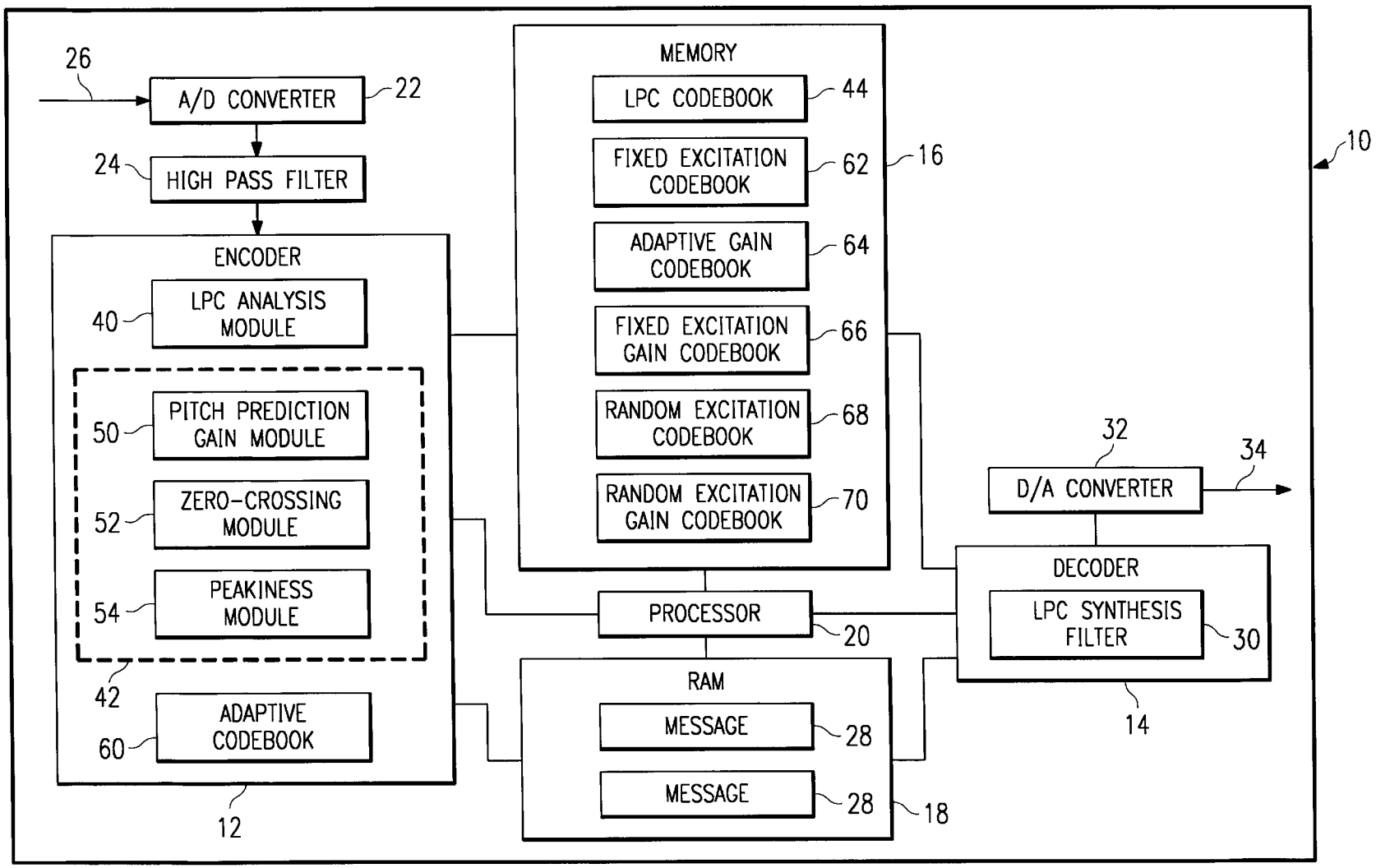
FIG. 1 illustrates a block diagram of code-excited linear prediction (CELP) coder in accordance with one embodiment of the present invention.
Figure 2:
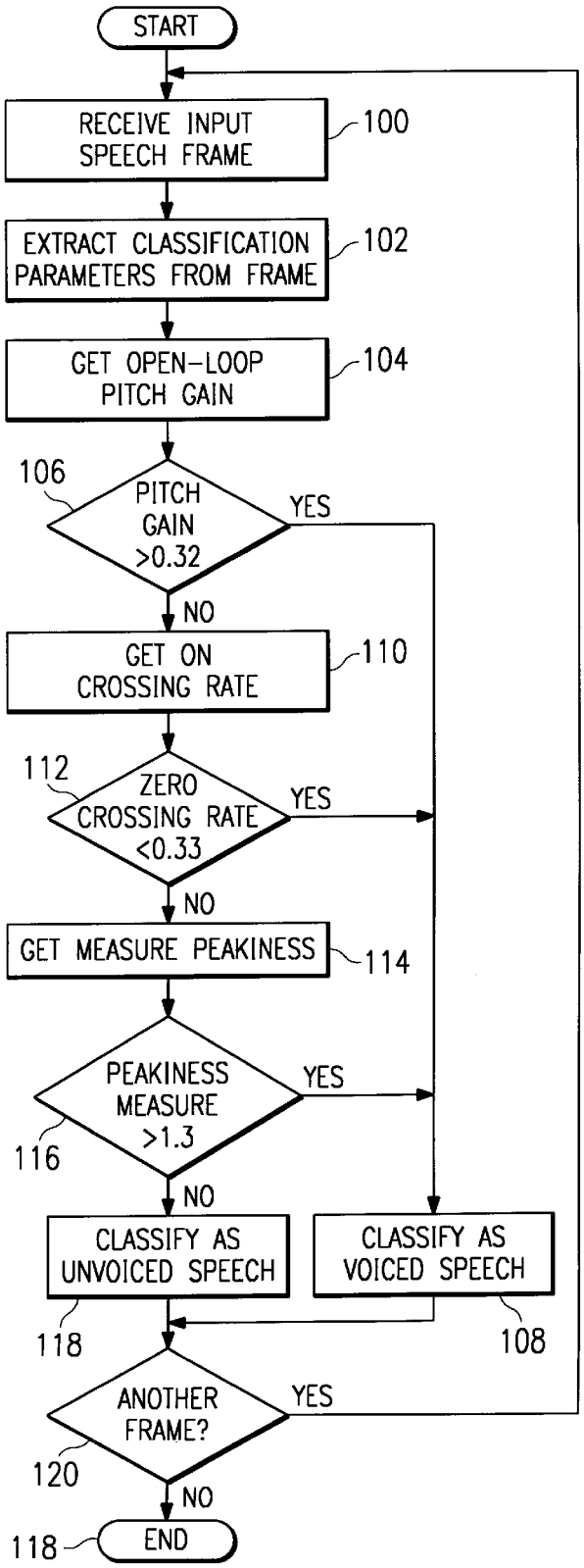
FIG. 2 illustrates a flow diagram of a method of characterizing voiced and unvoiced speech with the CELP coder of FIG. 1 in accordance with one embodiment of the present invention.
Figure 3:
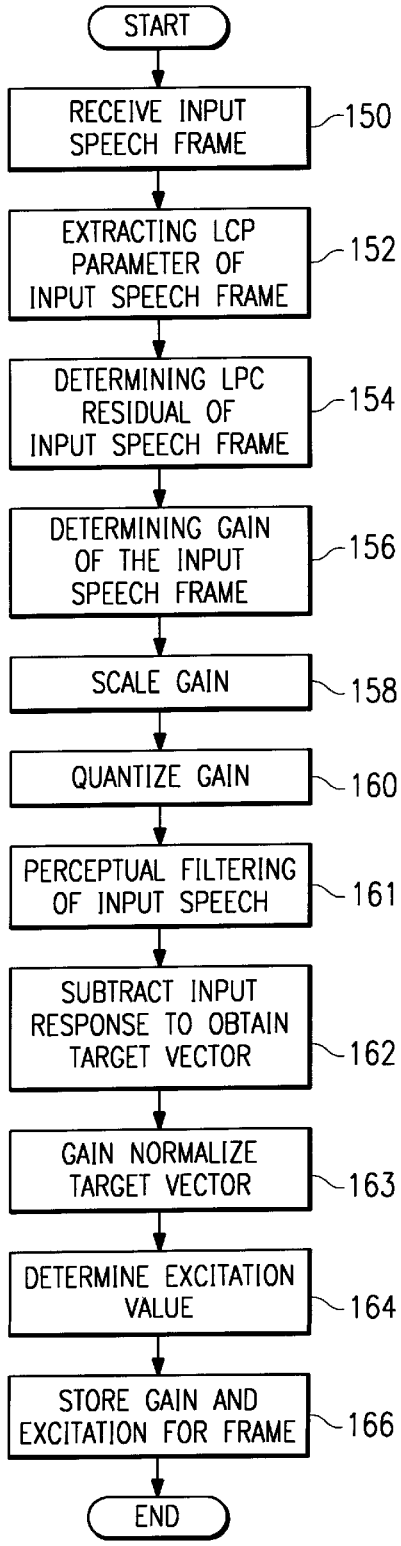
FIG. 3 illustrates a flow diagram of a method of coding unvoiced speech in accordance with one embodiment of the present invention.

The preferred embodiments of the present invention and its advantages are best understood by referring now in more detail to FIGS. 1–3 of the drawings, in which like numerals refer to like parts. As described in more detail below, FIGS. 1–3 illustrate a multimodal code-excited linear prediction (CELP) coder including a peakiness module operable to better distinguish between and classify speech. In accordance with another aspect of the present invention, the multimodal CELP coder may employ gain-matched analysis-by-synthesis encoding to reduce or eliminate gain fluctuations associated with speech coding.

FIG. 1 illustrates a block diagram of a multimodal CELP coder 10 in accordance with the present invention. In accordance with the invention, CELP coders may be linear prediction based analysis-by-synthesis speech coders which use an excitation which could be taken from a ternary, algebraic, vector-sum, randomly-populated, trained, adaptive or similar codebook.

In one embodiment, the multimodal CELP coder 10 may be utilized in a telephone answering device. It will be understood that the multimodal CELP coder 10 may be used in connection with other communication, telephonic, or other types of devices that provide synthesized speech. For example, the multimodal speech coder 10 may be employed by phone mail systems, digital sound recording devices, cellular telephones and the like.

The multimodal CELP coder 10 may comprise an encoder 12 and decoder 14 pair, memory 16, random access memory 18, and a processor 20. The processor 20 may carry out instructions of the encoded 12 and decoder 14. The encoder 12 may receive speech input through a conventional analog to digital converter 22 and a conventional high pass filter 24. The analog to digital converter 24 may convert analog input 26 signals into a digital format. The high pass filter 24 may remove DC components and other biasing agents from the input signal 26.

Generally described, the encoder 12 may operate on fixed-length segments of the input signal called frames. The encoder 12 may process each frame of speech by computing a set of parameters which it codes for later use by the decoder 14. These parameters may include a mode bit which informs the decoder 14 of the mode being used to code the current frame, linear prediction coefficients (LPC), which specify a time-varying all-pole filter called the LPC synthesis filter, and excitation parameters which specify a time-domain waveform called the excitation signal. The parameters of each frame may be stored as a coded message 28 in RAM 18. It will be understood that coded messages 28 may be otherwise stored within the scope of the present invention.

When a message 28 is to be replayed, the decoder 14 may receive the coded message 28 and synthesize an approximation to the input speech, called coded speech. The decoder 14 reconstructs the excitation signal and passes it through a LPC synthesis filter 30. The output of the synthesis filter 30 is the coded speech. The coded speech may be routed through a conventional digital-to-analog converter 32 where the coded speech is converted to an analog output signal 34.

The encoder 12 may include a linear prediction coding (LPC) analysis module 40 and mode modules 42. The LPC analysis module 40 may analyze a frame and determine appropriate linear prediction coding LPC coefficients. The LPC coefficients are calculated using well-known analysis techniques and quantized in a similar manner using predictive multi-stage vector quantization. The LPC coefficients may be quantized using an LPC codebook 44 stored in memory 16.

Mode decision modules 42 may include a pitch prediction gain module 50, a zero-crossing module 52 and a peakiness module 54 for classifying input speech into one of several modes characterized by distinct coding techniques. As described in more detail below, the multimodal CELP coder 10 may include a first mode characterized by fixed excitation and a second mode characterized by random excitation. The first mode may be better suited for signals with a certain degree of periodicity as well as signals that contain a few strong pulses or a localized burst of energy. As a result, voice sounds, including unvoiced plosives such as /t/, /k/, and /p/ can be modeled using the first mode. The second mode is adequate for signals where the LPC residual is noise-like, such as in fricative sounds such as /s/, /sh/, /f/, /th/, as well as portions of the input signal consisting of only background noise. Accordingly, unvoiced sounds may be modeled using the second mode.

The purpose of the mode decision is to select a type of excitation signal that is appropriate for each frame. In the first mode, the excitation signal may be a linear combination of two components obtained from two different codebooks, these codebooks may be an adaptive codebook 60 and a fixed excitation codebook 62. The adaptive codebook 60 may be associated with an adaptive gain codebook 64 and employed to encode pseudoperiodic pitch components of an LPC residual. The adaptive codebook 60 consists of time-shifted and interpolated values of past excitation.

The fixed excitation codebook 62 may be associated with a fixed gain codebook 66 and used to encode a portion of the excitation signal that is left behind after the adaptive codebook 60 contribution has been subtracted. The fixed excitation codebook 62 may include sparse codevectors containing only a small fixed number of non-zero samples, which can be either +1 or −1.

In the second mode, the excitation signal may be a gain-scaled vector taken from a random excitation codebook 70 populated with random Gaussian numbers. The random excitation codebook 70 may be associated with a random excitation gain codebook 72. In accordance with the present invention, the second mode may be encoded using gain-match analysis-by-synthesis encoding. This encoding method is described in more detail below in connection with FIG. 3.

The LPC codebook 44, fixed excitation codebook 62, fixed excitation gain codebook 66, random excitation codebook 68, and random excitation gain codebook 70 may be stored in the memory 16 of the multi-modal CELP coder 10. The adaptive codebook 60 may be stored in RAM 18. Accordingly, the adaptive codebook 60 may be continually updated. The adaptive gain codebook 64 may be stored in the encoder 12. It will be understood that the codebooks and modules of the CELP coder 10 may be otherwise stored within the scope of the present invention.

FIG. 2 illustrates a flow diagram of a method of classifying speech input into a first mode or a second mode in accordance with one embodiment of the present invention. In one embodiment, the first mode may have an excitation vector with fewer non-zero elements than the second mode. The first mode may generally be associated with voiced/transient speech and the second with unvoiced speech. The method begins at step 100 with the encoder 12 receiving an input speech frame. Proceeding to step 102, the encoder 12 may extract classification parameters of the speech frame. For the embodiment of FIG. 2, the classification parameters may comprise an open-loop pitch gain, a zero crossing rate, and a peakiness measure.

Next, at step 104, the open-loop pitch prediction gain module 50 may get an open-loop pitch gain of the speech frame. In one embodiment, the open-loop pitch prediction gain may be determined by maximizing a normalized auto correlation value. It will be understood that the open-loop prediction gain may be otherwise obtained within the scope of the present invention. Proceeding to decisional step 106, the open-loop pitch prediction gain module 50 may determine if the open-loop pitch prediction gain is greater than an open-loop pitch prediction gain threshold. In one embodiment, the open-loop pitch prediction gain threshold may range from 0.3 to 0.6. In a particular embodiment, the open-loop pitch prediction gain threshold may be 0.32. In this embodiment, the open-loop pitch prediction gain may be determined from the following equation:

$$\frac{\sum_{i=1}^{N} x(i)x(1-p)}{\left(\sum_{i=1}^{N} x(i)^2 \sum_{i=1}^{N} x^2(i-p)\right)^{\frac{1}{2}}}$$

where p=optional pitch lag i=time index x=signal

N=number of samples per frame.

It will be understood that the open-loop pitch prediction gain may be otherwise determined within the scope of the present invention.

If the pitch prediction gain is greater than the pitch prediction gain threshold, the YES branch of decisional step 106 leads to step 108. At step 108, the frame may be classified as voiced speech for fixed excitation encoding. If the open-loop pitch prediction gain is less than the open-loop pitch prediction gain threshold, the NO branch of decisional step 106 leads to step 110.

At step 110, the zero-crossing module 52 may get a zero-crossing rate of the speech frame. The zero crossing rate may be the number of times that the sign of the signal changes within a frame divided by the number of samples in the frame. Proceeding to decisional step 112, the zero-crossing module 52 may determine if the zero-crossing rate of the speech frame is less than a zero-crossing rate threshold. In one embodiment, the zero-crossing rate threshold may range from 0.25 to 0.4. In a particular embodiment, the zero-crossing rate threshold may be 0.33. If the zero-crossing rate is less than the zero-crossing rate threshold, the YES branch of decisional step 112 may lead to step 108. As previously discussed, the speech frame may be classified as voiced speech at step 108. If the zero-crossing rate is not less than the zero-crossing rate threshold, the NO branch of decisional step 112 leads to step 114. At step 114, the peakiness module 54 may get a peakiness measure of the speech frame. In one embodiment, peakiness measure may be calculated as follows:

$$P = \frac{\left(\frac{1}{N}\sum_{n=1}^{N} r^2[n]\right)^{\frac{1}{2}}}{\frac{1}{N}\sum_{n=1}^{N} |r[n]|}$$

where

P=peakiness measure r [n]=LPC residual

N=number of samples in frame

Step 114 leads to decisional step 116. At decisional step 116, the peakiness module 54 may determine if the peakiness measure is greater than a peakiness threshold. In one embodiment, the peakiness threshold may range from 1.3 to 1.4. In a particular embodiment, the peakiness threshold may be 1.3. If the peakiness measure is greater than the threshold, the YES branch of decisional step 116 may lead to step 108. As previously described, the speech frame may be classified as voiced speech at step 108. If the peakiness measure is not greater than the threshold, the NO branch of decisional step 116 leads to step 118.

At step 118, the speech frame may be classified as unvoiced speech. Steps 108 and step 118 may lead to decisional step 120. At decisional step 120, the encoder 12 may determine if another input speech frame exists. If another frame exists, the YES branch of decisional step 120 returns to step 100 wherein the next frame is received for classification. If another speech frame does not exist, the NO branch of decisional step 120 leads to the end of the method.

Accordingly, only frames having an open-loop pitch prediction gain not greater than a threshold value, a zero-crossing rate not less than a threshold value and a peakiness measure is not greater than a peakiness threshold will be classified as unvoiced speech. From the peakiness equation, a speech frame will have a large peakiness measure where it contains a small number of samples whose magnitudes are much larger than the rest. The peakiness measure of the frame, however, will become small if all the samples are comparable in terms of their absolute value. Accordingly, a periodic signal with sharp pulses will have a large peakiness value, as will a signal which contains a short burst of energy in an otherwise quiet frame. On the other hand, a noise-like signal such as an unvoiced fricative will have a small peakiness value. Accordingly, the beginning or end of a voiced utterance will be properly coded as voiced speech and speech quality improved.

FIG. 3 illustrates a gain-match analysis-by-synthesis for coding mode two speech in accordance with one embodiment of the present invention. The method begins at step 150 wherein the encoder 12 receives an input speech frame. Proceeding to step 152, the encoder 12 may extract LPC parameters of the input speech frame. At step 154, an LPC residual of the input speech frame may be determined. The LPC residual is a difference between the input speech and the speech predicted by the LPC parameters.

Proceeding to step 156, a gain of the LPC residual may be determined. In one embodiment, the gain may be determined by the following equation:

$$g = \left(\frac{1}{N}\sum_{n=1}^{N} r^2(i)\right)^{\frac{1}{2}}$$

where g=gain i=time index

N=number of samples r=residual

Next, at step 158, the gain may be scaled. In one embodiment, the gain may be scaled by multiplying the gain by a constant scale factor known as the CELP muting factor. This constant is empirically estimated and may be the average ratio of the gain of the coded speech to the original speech for all speech frames coded in the first voiced mode. The scaling matches the coded speech energy levels in both modes of the coder. It may be assumed that all the code-vectors in the excitation codebook have a unit norm. The gain may then be quantized at step 160.

Proceeding to step 161, a target vector may be obtained by filtering the speech frame through a pole-zero perceptual weighting filter W(z)and by subtracting from the result the zero-input response of the perceptually weighted synthesis filter at step 162. The perceptually weighted synthesis filter may be given by A(z)W(z), where:

$$W(z) = \frac{A(\gamma\ z^{-1})}{A(\lambda\ z^{-1})}$$

and $$A(z) = 1 - \sum_{i=1}^{P} a_i z^{-i}$$

where

X are constants (for example $\gamma$=0.9, $\lambda$=0.6), $a_i$=LPC coefficients P=prediction order Proceeding to step 163, the target vector may be gain-normalized. In one embodiment, the target vector may be gain-normalized by dividing the input speech by the gain. Accordingly, the synthetic speech will have the correct gain value, which is generally more important than the shape of the excitation vector for most unvoiced signals. This is done by precomputing the gain and using it to rescale the excitation target vector, before performing any analysis-by-synthesis quantization of the gain-normalized target vector with a vector from the excitation codebook. Accordingly, the present invention allows for the coded speech gain to match the input speech gain while still performing analysis-by-synthesis coding.

Proceeding to step 164, the excitation value of the gain normalized speech frame may be determined. The optimum excitation vector may be obtained by minimizing the following equation:

$$D' = \|\underline{s}' - H\underline{e}\|^2$$

where

D'=weighted squared error between original and synthesized speech $\underline{s}'$=gain normalized target vector H=impulse response matrix of perceptually weighted synthesis filter, W(z)A(z)

$\underline{e}$=optimal excitation vector

The impulse response matrix may be given by:

$$H = \begin{bmatrix} h(0) & 0 & 0 & 0 \ldots & 0 \\ h(1) & h(0) & 0 & & 0 \\ h(2) & h(1) & h(0) & & 0 \\ \vdots & \vdots & \vdots & & \vdots \\ h(N-1) & h(N-2) & h(N-3) & & h(0) \end{bmatrix}$$

where

N=frame size h(i) for i=0 . . . N−1=impulse response of W(z)A(z)

The optimum excitation may thus be found by minimizing the following equation using analysis-by-synthesis:

$$C' = \|H\underline{e}\|^2 - 2\langle \underline{s}', H\underline{e} \rangle$$

where

C'=cost function

H=impulse response matrix of perceptually weighted synthesis filter, W(z)A(z)

$\underline{e}$=optimal excitation vector $\underline{s}'$=gain normalized target vector Next, at step 166, the encoder 12 may store the excitation parameters of the speech frame as part of a coded message 28. As previously described, the coded message may also include a mode bit and LPC coefficients. Step 166 leads to the end of the process.

In accordance with the foregoing, the present invention ensures that the synthesized speech will have the correct gain value. At the same time, analysis-by-synthesis is performed to help retain the character of the input signal. As a result, unwanted gain fluctuations are substantially reduced or eliminated.

Although the present invention has been described with several embodiments, various changes and modifications may be suggested to one skilled in the art. It is intended that the present invention encompass such changes and modifications as fall within the scope of the appended claims.

What is claimed is:

1. A method of classifying speech, comprising the steps of:

receiving a speech input;

getting a peakiness measure of the speech input where said peakiness measure is independent of pitch lag;

determining if the peakiness measure is greater than a peakiness threshold;

if the peakiness measure is greater than the peakiness threshold, classifying the speech input in a first mode of a multimodal speech coder including a code-excited linear prediction mode.

2. The method of claim 1, further comprising the steps of:

getting an open-loop pitch prediction gain of the speech input;

determining if the open-loop pitch prediction gain is greater than an open-loop pitch prediction gain threshold; and if the open-loop pitch prediction gain is greater than the open-loop pitch prediction gain threshold, classifying the speech input in the first mode of the multimodal speech order including the code-excited linear prediction mode.

3. The method of claim 2, further comprising the step of classifying the speech input in a second mode having excitation vectors with a greater number of non-zero elements than the first mode if the speech input is not classified in the first mode.

4. The method of claim 3, wherein the first mode comprises pulse excitation and the second mode comprises random excitation.

5. The method of claim 1, further comprising the steps of:

getting a zero-crossing rate of the speech input;

determining if the zero-crossing rate is less than a zero-crossing rate threshold; and if the zero-crossing rate is less than the zero-crossing rate threshold, classifying the speech input as the first mode type for fixed excitation encoding.

6. The method of claim 5, further comprising the step of classifying the speech input in a second mode having excitation vectors with a greater number of non-zero elements than the first mode if the speech input is not classified in the first mode.

7. The method of claim 6, wherein the first mode comprises pulse excitation and the second mode comprises random excitation.

8. The method of claim 1, further comprising the steps of:

getting an open-loop pitch prediction gain of the speech input;

determining if the open-loop pitch prediction gain is greater than an open-loop pitch prediction gain threshold;

if the open-loop pitch prediction gain is greater than the open-loop pitch prediction gain threshold, classifying the speech input in the first mode of the multimodal speech coder including the code-excited linear prediction mode;

getting a zero-crossing rate of the speech input;

determining if the zero-crossing rate is less than a zero-crossing rate threshold; and if the zero-crossing rate is less than the zero-crossing rate threshold, classifying the speech input in the first mode of the multimodal speech coder including the code-excited linear prediction mode.

9. The method of claim 8, further comprising the step of classifying the speech input in a second mode having excitation vectors with a greater number of non-zero elements than the first mode if the speech input is not classified in the first mode.

10. The method of claim 1, further comprising the step of classifying the speech input in a second mode having excitation vectors with a greater number of non-zero elements than the first mode if the speech input is not classified in the first mode.

11. The method of claim 10, wherein the first mode comprises pulse excitation and the second mode comprises random excitation.

12. A method of encoding speech, comprising the steps of:

getting a gain value from an input speech;

obtaining a target vector from the input speech;

gain normalizing the target vector; and determining an optimal excitation vector by minimizing an error between the gain normalized target vector and a synthesis-filtered excitation vector.

13. The method of claim 12, further comprising the step of scaling the gain with a muting factor.

14. The method of claim 13, further comprising the step of quaniticizing the scaled gain.

15. The method of claim 13, further comprising the step of quantizing the scaled gain.

16. A method of encoding speech, comprising the steps of:

getting a gain value from an input speech;

gain normalizing the input speech;

obtaining a target vector from the gain normalized input speech;

determining an optimal excitation vector by minimizing an error between the target vector of the gain normalizing input speech and a synthesis-filtered excitation vector.

17. A method of classifying speech, comprising the steps of:

receiving a speech input;

getting a first value by computing the p-th root of the sum of the p-th powers of the absolute values of the components of the speech input vector;

getting a second value by computing the n-th root of the sum of the n-th powers of the absolute values of the components of the speech input vector;

getting a peakiness measure of the speech input by dividing said first value by said second value;

determining if the peakiness measure is greater than a peakiness threshold; and if the peakiness measure is greater than the peakiness threshold, classifying the speech input in a first mode of a multimodal speech coder including a code-excited linear prediction mode.

18. The method of claim 17 where n=1 and p=2.

19. A code-excited linear prediction (CELP) coder, comprising:

an encoder operable to receive a speech input;

a peakiness module in communication with the encoder;

the peakiness module operable to get a peakiness measure of the speech input where said peakiness measure is independent of pitch lag and to determine if the peakiness measure is greater than a peakiness threshold;

the encoder operable to classify the speech input in a first mode where the peakiness measure is greater than the peakiness threshold; and the encoder operable to encode first mode input speech with a pulse excitation system.

20. The CELP coder of claim 19, further comprising:

the encoder operable to classify the speech input in a second mode where it is not classified in the first mode; and the encoder operable to encode second mode speech input with a random excitation system.

21. The CELP coder of claim 19, further comprising:

a pitch prediction gain module in communication with the encoder;

the pitch prediction gain module operable to get an open-loop pitch prediction gain of the speech input and to determine if the open-loop pitch prediction gain is greater than an open-loop pitch prediction gain threshold; and the encoder operable to classify the speech input as the first mode type where the open-loop pitch prediction gain is greater than the open-loop pitch prediction gain threshold.

22. The CELP coder of claim 19, further comprising:

a zero-crossing rate module in communication with the encoder;

the zero-crossing rate module operable to get a zero-crossing rate of the speech input and to determine if the zero-crossing rate is less than a zero-crossing rate threshold;

the encoder operable to classify the speech input as the first mode type where the zero-crossing rate is less than the zero-crossing rate threshold.

* * * * *